US007494126B2

(12) United States Patent
Gordon et al.

(10) Patent No.: US 7,494,126 B2
(45) Date of Patent: Feb. 24, 2009

(54) SYSTEM AND METHOD OF PLAYING A MULTI-GAME CARD TOURNAMENT

(76) Inventors: David Gordon, 5637 Green Oak Dr., Los Angeles, CA (US) 90068; Mary Lane, 5637 Green Oak Dr., Los Angeles, CA (US) 90068

( * ) Notice: Subject to any disclaimer, the term of this patent is extended or adjusted under 35 U.S.C. 154(b) by 278 days.

(21) Appl. No.: 11/286,480

(22) Filed: Nov. 23, 2005

(65) Prior Publication Data

US 2006/0138728 A1 Jun. 29, 2006

Related U.S. Application Data

(60) Provisional application No. 60/630,784, filed on Nov. 23, 2004.

(51) Int. Cl.
*A63F 1/00* (2006.01)
*A63F 9/20* (2006.01)

(52) U.S. Cl. ..... 273/292

(58) Field of Classification Search ..... 273/292
See application file for complete search history.

(56) References Cited

U.S. PATENT DOCUMENTS 6,174,237 B1 * 1/2001 Stephenson ..... 463/42
2005/0102047 A1 * 5/2005 Ottofy ..... 700/91
2005/0173862 A1 * 8/2005 Orenstein ..... 273/292

* cited by examiner

*Primary Examiner*—Eugene Kim
*Assistant Examiner*—Michael D Dennis
(74) *Attorney, Agent, or Firm*—O'Melveny & Myers LLP

(57) ABSTRACT

At least two card games (i.e., multi-card games) are played tournament style to determine at least one winner, or the best card player or team of players. In accordance with a first embodiment of the present invention, three card games are played tournament style to determine the best card player. In accordance with a preferred embodiment of the present invention, the three card games include poker (e.g., Seven Card Stud, Texas Hold-Em, etc.), rummy (e.g., Gin Rummy, etc.), and bridge (e.g., Whist, Auction Bridge, Contract Bridge, etc.). In one embodiment of the present invention, the tournament includes a plurality of individual or team players. Scores in each game are used to rank players (e.g., best individual poker player, best poker team, etc.) and to determine the best overall card player (e.g., by adding the scores together, etc.). Prizes may then be distributed to the overall best card player, the overall second best card player, the best poker player, the best rummy player, the best bridge player, etc.

12 Claims, 7 Drawing Sheets

Players

| | |
|---|---|
| A-1, A-2 | Team A |
| B-1, B-2 | Team B |
| C-1, C-2 | Team C |
| D-1, D-2 | Team D |
| E-1, E-2 | Team E |
| F-1, F-2 | Team F |
| G-1, G-2 | Team G |
| H-1, H-2 | Team H |

Table-1

Table-2

Players

| | |
|---|---|
| A-1, A-2 | Team A |
| B-1, B-2 | Team B |
| C-1, C-2 | Team C |
| D-1, D-2 | Team D |
| E-1, E-2 | Team E |
| F-1, F-2 | Team F |
| G-1, G-2 | Team G |
| H-1, H-2 | Team H |

Table-1

Table-2

Round 1

Assume the lower letter player wins

Round 4

3-0 Players

Assume lower letter player wins

A1
A2
A1 (4-0)

A2 has a (3-1) Record 2-1 Players

E1
C1
C1 (3-1)

E2
B1
B1 (3-1)

B2
C2
B2 (3-1)

E1, E2 & C2 all have (2-2) Records 1-2 Players

D1
G1
D1 (2-2)

D2
F1
D2 (2-2)

F2
G2
F2 (2-2)

G1, F1 & G2, all have (1-3) Records 0-3 Players

H1
H2
H1 (1-3)

H2 has a 0-4 Record

FIG. 2

Round 5

Top / Bottom Bracket

Assume lower letter player wins

A1 (4-0)
H2 (0-4) — A1 (5-0)

H2 has a 0-5 Record 3-1 Bracket

A2 (3-1)
B1 (3-1) — A2 (4-1)

B2 (3-1)
C1 (3-1) — B2 (4-1)

B1 & C1 have 3-2 Records 2-2 Bracket

D1 (2-2)
E1 (2-2) — D1 (3-2)

D2 (2-2)
E2 (2-2) — D2 (3-2)

C2 (2-2)
F2 (2-2) — C2 (3-2)

E1, E2 & F2 have 2-3 Records 1-3 Bracket

G1 (1-3)
H1 (1-3) — G1 (2-3)

F1 (1-3)
G2 (1-3) — F1 (2-3)

H1 & G2 have 1-4 Records

FIG. 2

Round 6

SYSTEM AND METHOD OF PLAYING A MULTI-GAME CARD TOURNAMENT

RELATED APPLICATION DATA

This patent application claims priority pursuant to 35 U.S.C. § 119(e) to provisional patent application Ser. No. 60/630,784, filed Nov. 23, 2004.

BACKGROUND OF THE INVENTION

1. Field of the Invention

The present invention relates to card tournaments, and more particularly, to a system and method of determining the best card player by participating in a multi-game card tournament.

2. Description of Related Art

Since the 19th century, three types of card games have captured the popular imagination: poker, rummy and bridge. Poker is currently the most popular card game in the world. It is played by many persons, and at present large numbers of people watch televised poker tournaments. It has achieved an audience that includes non-players. The most popular forms of poker are Texas Hold-Em, Seven Card Stud, Low-Ball, Omaha and Draw Poker. Books on card games, however, list over 30 variations of poker. Usually, poker is played by five or more players.

Rummy is thought to be the second most popular card game in this country, and the most popular card game for two players. Gin rummy, which evolved from poker and became popular in the 20th century, has as its object the forming of matched sets of cards of the same rank and sequences of cards of the same suit, the deduction of which from the hand will bring the value of the remaining unmatched cards to below a certain number. There seem to be at least 20 variations of rummy.

Bridge developed out of the English game of Whist, first played more than 400 years ago. Bridge evolved in the United States in the late 19th century, and thereafter became Auction Bridge and finally Contract Bridge. Bridge was extremely popular in the 1920's and though its popularity has been eclipsed of late by poker and gin rummy, bridge nevertheless has a consistent following to this day. In bridge, only four persons (i.e., two teams of two) can play a game at one time. Bridge tournaments involve many tables playing the very same cards, so that the skill of the players can be measured apart from the element of luck.

Advocates of each of these types of games argue that their game is the ultimate skill game and that the people who are the best at their game are the best card players in the world. However, there is currently no way to determine what individual or team is the best at all three games, or the best card player overall. Therefore, it would be very desirable to develop a system and method of participating in a multi-game card tournament to determine who is the best card player.

SUMMARY OF THE INVENTION

Figure 1:
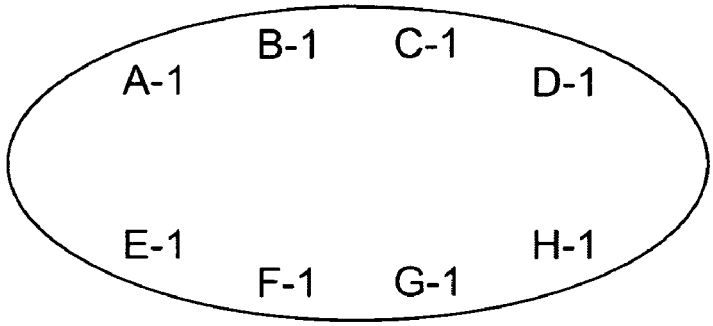
FIG. 1 illustrates, according to one embodiment of the present invention, participants in a tournament being seated around a plurality of poker tables.
Figure 1:
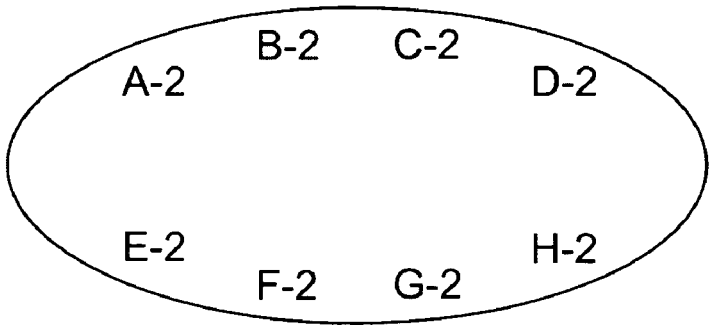

In accordance with the teachings of the present invention, at least two card games (i.e., multi-card games) are played tournament style to determine at least one winner, or the best card player. In one embodiment of the present invention, three card games are played tournament style to determine the best card player. In a preferred embodiment of the present invention, the three card games include poker (e.g., Seven Card Stud, Texas Hold-Em, etc.), rummy (e.g., Gin Rummy, etc.), and bridge (e.g., Whist, Auction Bridge, Contract Bridge, etc.).

It should be appreciated that while the present invention is described herein in terms of a particular three-card game tournament having particular rules, the present invention is not so limited. Therefore, a tournament including more (or less) card games, at least one different card game, and/or card games played according to different rules is considered to be within the spirit and scope of the present invention.

Difficulties encountered in devising a multi-card game tournament include (i) arranging individual games (or rounds therein), (ii) scoring individual games and (iii) weighing individual scores to determine an overall winner. This becomes more difficult when the tournament is made up of at least one individual-player game (e.g., poker) and at least one team-player game (e.g., bridge).

DETAILED DESCRIPTION OF A PREFERRED EMBODIMENT

In a preferred embodiment of the present invention, a tournament is made up of three card games—poker, rummy and bridge. These three games, at least today, are arguably the most popular card games of skill. The goal of the tournament is to determine a winner, or "the best card player." Such a tournament is complex, for example, because it includes bridge, which is a team-player game. In one embodiment of the present invention, the participants constituting a team will not be allowed to collaborate to the detriment of the other participants during the non team-player games (e.g., poker and rummy). In other words, for example, teammates may be seated at different tables during individual-player games, etc.

In one embodiment of the present invention, the tournament takes place over several days, for example, Friday through Sunday at a location to be selected. The location, for example, could be a country club with guest facilities, a Las Vegas or Atlantic City hotel, an Indian reservation casino, a cruise or river ship or any other place where the tournament is lawful. Participants would pay their own costs (e.g., an entry fee) and a non-participating entity (e.g., a tournament committee, sponsor, etc.) would be responsible for the operating expenses (e.g., obtaining a tournament room, refreshments, judges, etc.). In an alternate embodiment of the present invention, at least a portion of the entry fees would be used to cover at least a portion of the operating expenses. As a further alternative embodiment, a commercial sponsor may contribute amounts to the tournament that would add to the prize money.

The order of the games could be predetermined or determined at random. Preferably, each session would last a substantial amount of time. In one embodiment of the present invention, each session would last 6-8 hours, with the Friday session starting at 6 p.m., the Saturday session starting at 3 p.m., and the Sunday session starting at 9 a.m. It should be appreciated, however, that sessions having different durations and/or different start times (or days) are within the spirit and scope of the present invention.

In one embodiment of the present invention, teams of two would post entry fees in advance of the tournament. It is contemplated that the first tournament could have entry fees in the range of $4,000 to $10,000 per team, although any fee structure could be used. Fees may be nonrefundable or become nonrefundable at a specified time. If any teams drop out thereafter, replacement teams could be selected from a waiting list maintained for that purpose. Entry fees for replacement players or teams may be less than the original entry fees if the original entry fees (or a portion thereof) have become nonrefundable.

By way of example, if the tournament includes eight teams of two, and the entry fee is $4,000 per team, the $32,000 entry fees could be split at follows: $16,000 to the overall first place team; $4,000 to the overall second place team; $4,000 to the winning poker team; $4,000 to the winning rummy team; and $4,000 to the winning bridge team. All players could be provided with souvenirs and the winners could also be given trophies. This structure does not leave room for expenditures of the tournament, which could be paid by non-participating entities (e.g., a tournament committee, sponsors, etc.) or by increasing the entry fee.

It should be appreciated that the present invention is not limited to team entrants. Thus, for example, a tournament that pairs individual entrants into teams for the team-player game segment of the tournament (e.g., the bridge segment, etc.) is within the spirit and scope of the present invention. It should further be appreciated that the present invention is not limited to any particular number of entrants. However, if the number of entrants are even, teams can easily be formed. Alternatively, if the number of entrants are odd, the tournament would need to be structured accordingly (e.g., to not include team-player games, by assigning byes, etc.).

Poker Segment

In one embodiment of the present invention, the tournament includes eight teams of two and a poker segment, wherein the poker segment is played using a plurality of poker tables. At each table, eight participants are seated to play a number or hands of poker (e.g., Seven Card Stud, Texas Hold-Em, etc.). In a preferred embodiment of the present invention, team members will be seated at different tables. This is shown in FIG. 1. For example, participant A1 is seated at a first table and participant A2 (i.e., A1's teammate) is seated at a second table.

In this embodiment, each participant will start with an amount of chips equal to one-half the team prize for winning the poker segment. Thus, for example, if the first place prize is $4,000, each participant will start with $2,000 in chips. Play continues on each table until one participant on the table has all the chips for that table, or until the assigned time for the poker segment elapses (i.e., if no one player has acquired all of that table's chips).

In one embodiment of the present invention, the poker segment would start as a limit game, with initial betting intervals of $20/$40. Bets would then go up according to a schedule (e.g., at a set number of hands, at set time intervals, etc.). Eventually, the game will become pot limit. It should be appreciated, however, that the present invention is not limited to a poker segment having any particular type of stakes (e.g., limit bets, pot limit, table stakes, no limit, increasing stakes, decreasing stakes, constant stakes, etc.). It is preferred, however, that the participants be aware of the stakes prior to beginning or entering the tournament.

In one embodiment of the present invention, a team's score for poker is the sum of the two participants' table scores. That is, if one participant gets third place and the other gets fourth place, the team score is seven. Teams could then be ranked by numbers, in which the team with the lowest number is first, etc. The result could then be a ranking of the teams from one to eight for the poker segment. If more than one team shares the number one ranking, all such teams could share equally in the winnings for the poker segment.

It should be appreciated that the present invention is not limited to a poker segment or a poker segment played according to the rules of any particular poker game. Thus, for example, a tournament that includes a poker segment played according to the rules of Texas Hold-Em, Seven Card Stud, Five Card Draw, Omaha, or any other poker game known to those skilled in the art, with such rules and/or variations as may be determined by a non-participating entity (e.g., the tournament director, etc.), is within the spirit and scope of the present invention.

Rummy Segment

In one embodiment of the present invention, the rummy segment of the tournament is played using Gin Rummy rules. In this embodiment, a particular number of rounds of Gin Rummy are played, wherein each round is played to a particular point total.

In a preferred embodiment of the present invention, each participant will play a number of rounds of gin rummy equal to the number of rounds that produces a winner plus two additional rounds. As described below, the concept of multiple rounds allows winners and losers of previous rounds to continue playing against other players and, as illustrated below, allows a player with one loss to eventually play against the player who is undefeated after the number of rounds that produces one undefeated player. For example, with 16 players, it takes four rounds to produce one undefeated player. Accordingly, with 16 players there would be six rounds (four to produce an undefeated player then two follow up rounds). As an additional alternative, if the two top players have identical records at the end of the six rounds (that is, two players have win/loss records of 5-1), a seventh round could be played. A round is over when one player has scored 200 points. The rules of this embodiment may be as follows:

1. Game is 200 points; gin is 25 points; undercut is difference plus 25 points; box differential is 25 points; game bonus is 100 points.
2. Knock count is determined by first upcard. Ace requires gin.
3. First dealer is chosen randomly. Afterwards, winner deals, i.e., the loser gets to decide what to do with upcard.
4. If no one knocks, the hand is over when two cards remain in the stock pile.
5. Participants with identical records will be ranked by box differentials. If box differentials are the same, point differentials will considered. For example, if two participants end up 4-2 after six rounds, the participant with the highest box differential over six rounds wins. If the box differential is the same, the point differentials will be considered. Negative and positive differentials will be considered. For example, if two participants have 2-4 records, the participant with a negative box differential of three beats a participant with a negative of five.
6. Team scores will be the sum of the individual rankings. For example, if a team has participants that come in first and tenth, the team score is eleven. Teams are then ranked by numbers and the team with the lowest number is first, etc.

It should be appreciated that the aforementioned rules, as with all the descriptions provided herein, are merely provided to illustrate an exemplary tournament that operates in accordance with one embodiment of the present invention, and are not to be considered limitations of the present invention. Thus, for example, a multi-card game tournament that operates under rules that are different than the rules described herein is considered to be within the spirit and scope of the present invention. Rules that might be used, for example, include rules of Canasta or other rummy-type games generally known to those skilled in the art (including common variations thereof).

Figure 2:
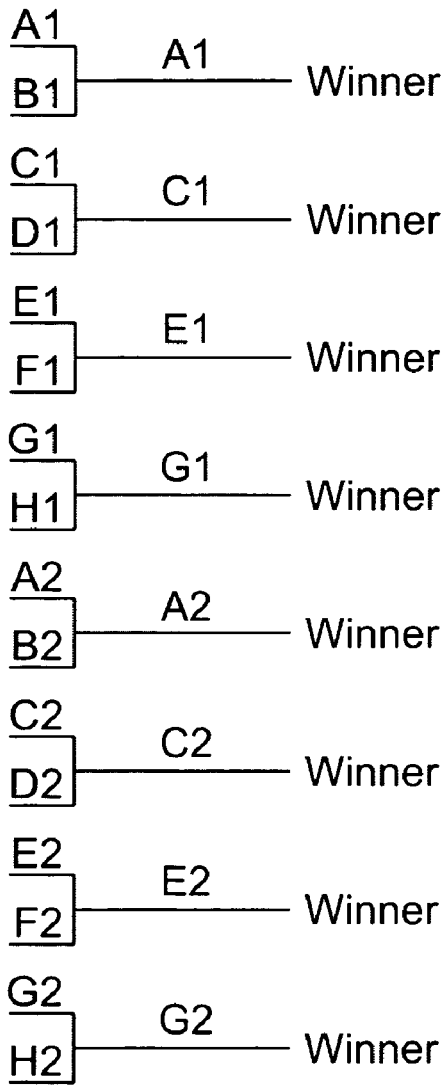
FIGS. 2(1)-2(6) illustrate, according to one embodiment of the present invention, participants in a tournament being paired up to play several rounds of rummy.
Figure 2:
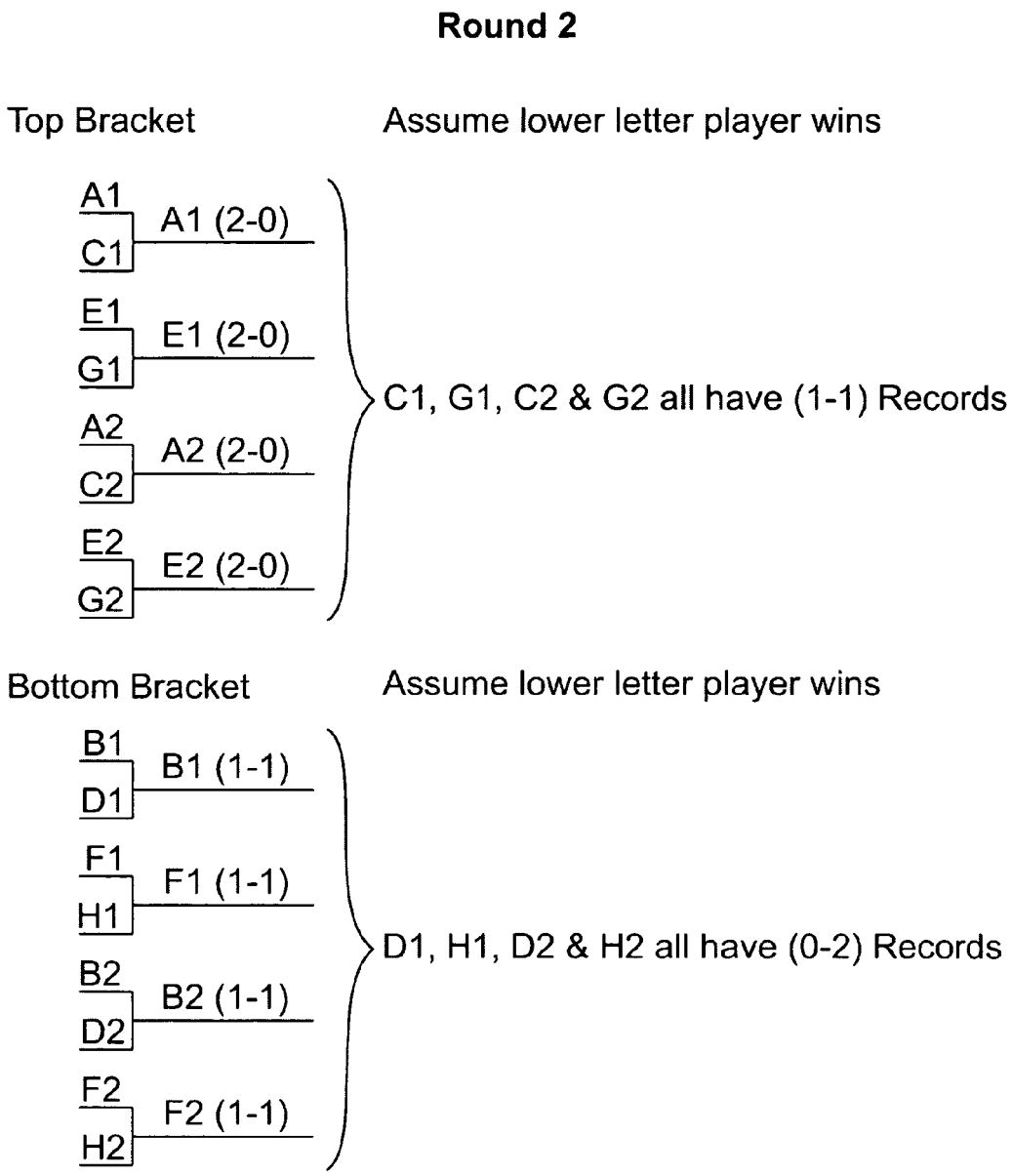
Figure 2:
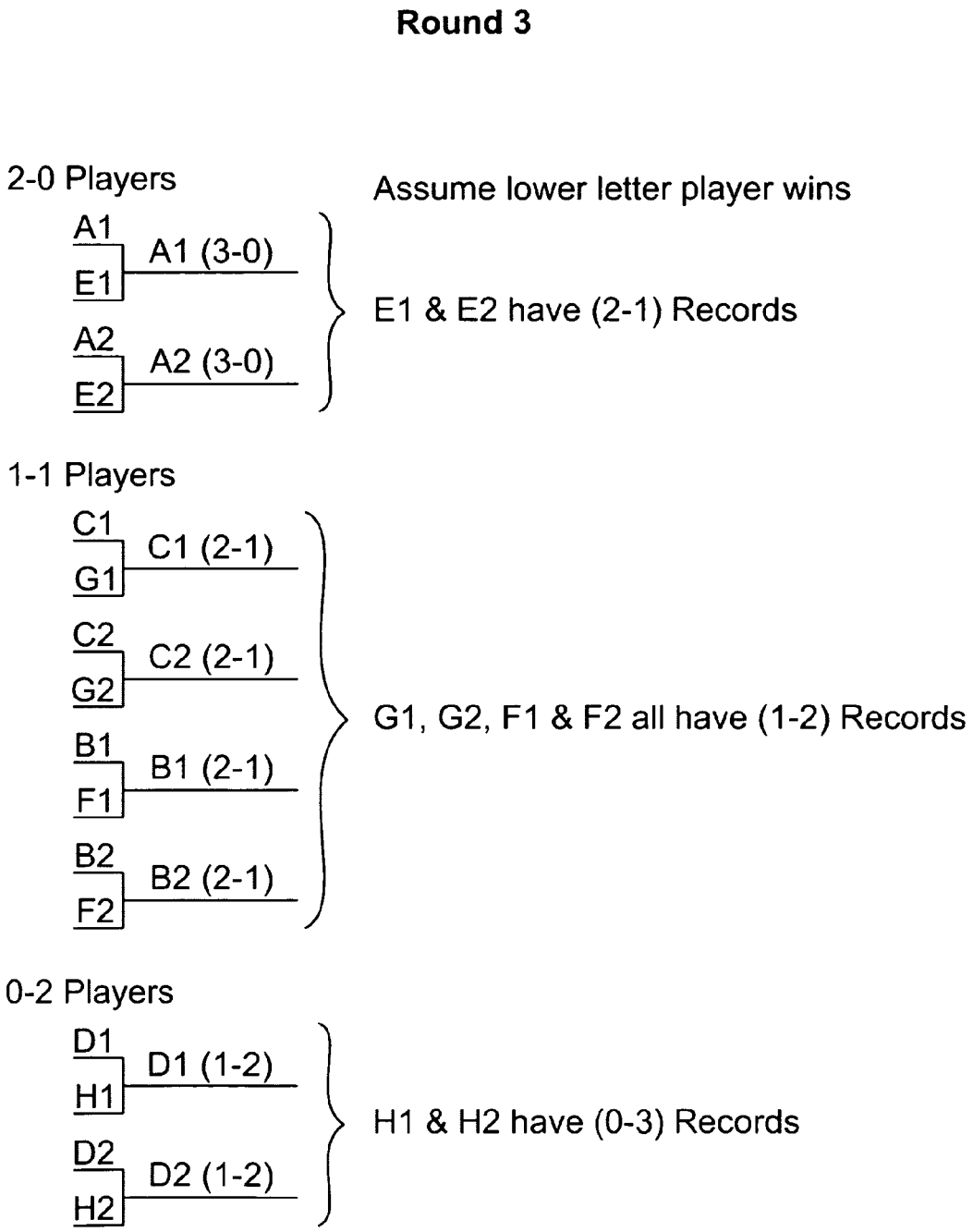
Figure 2:
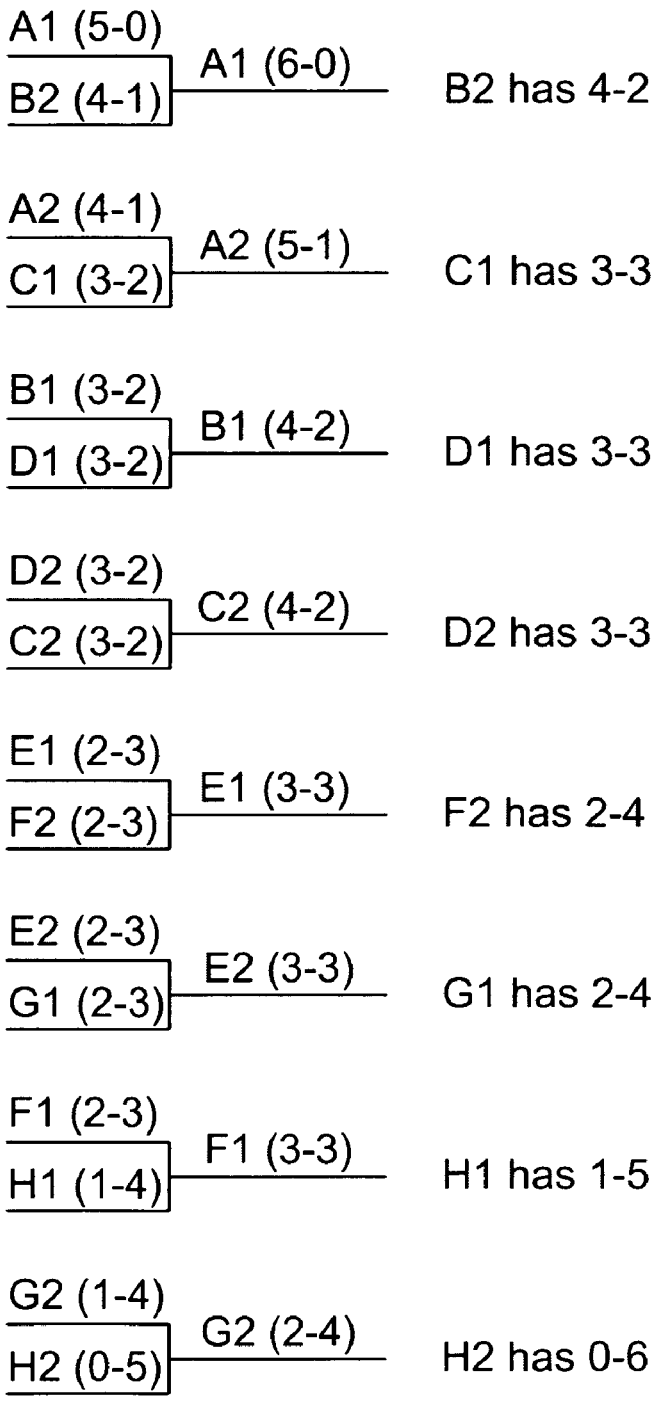

In playing multiple rounds of Gin Rummy, the participants could be paired together using a number of different techniques. In a preferred embodiment of the present invention, if there were 16 participants, they would be sorted into groups of eight, wherein teammates are placed in separate groups. For example, a first teammate (e.g., A1) would be placed in a first group of eight and a second teammate (e.g., A2) would be placed in a second group of eight. The participants in the first and second groups are then paired and a first round of Gin Rummy is played. This is shown in FIG. 2(1).

The winners of the first round and the losers of the first round, respectively, are then paired up to play each other in the second round. If possible, participants will be sorted so as to not play each other twice. An example of the pairing in round two is shown in FIG. 2(2). As can be seen, winners are paired to play winners (e.g., A1 vs. C1, etc.) and losers are paired to play losers (e.g., B1 vs. D1, etc.).

In round three, participants will either have a record of 2-0, 1-1, or 0-2. As with round two, participants having identical records are paired up to play each other in round three. An example of the pairing in round three is shown in FIG. 2(3). As can be seen, for example, undefeated participants (i.e., A1, E1, A2, E2) are paired up to play each other.

In round four, participants will either have a record of 3-0, 2-1, 1-2, or 0-3. As with previous rounds, participants having identical records are paired up to play each other in round four. An example of the pairing in round four is shown in FIG. 2(4). As can be seen, for example, undefeated participants (i.e., A1, A2) are paired up to play each other.

In round five, participants will either have a record of 4-0, 3-1, 2-2, 1-3, or 0-4. In this round, the undefeated participant (i.e., having record 4-0) will play the non-winning participant (i.e., having record 0-4). All other participants having identical records are paired up to play each other. An example of the pairing in round five is shown in FIG. 2(5). As can be seen, for example, all participants that have a record of 3-1 (i.e., A2, B1, B2, C1) are paired up to play each other. As an alternative to this structure, the 4-0 player could be paired against the 3-1 player with the best box differential, with corresponding adjustments throughout the remaining pairings.

In round six, participants records may vary from 5-0 to 0-5. In this round, participants having identical records (or close to identical records) are paired up to play each other. An example of the pairing in round six is shown in FIG. 2(6). As can be seen, for example, participants having the highest record(s) (e.g., A1, B2) are paired up to play each other. Similarly, participants having the lowest record(s) (e.g., G2, H2) are paired up to play each other.

At the end of the rummy segment, individual participants will be assigned ranks. The ranks of participants with equal records will be allocated in accordance with their box differentials or in the case of ties, total points. For example, as shown in FIG. 2(6), participants B1, C2 and B2 all have records of 4-2 (i.e., won 4, lost 2). They will be allocated ranks 3, 4 and 5 based on the box differentials (or, if necessary total points) they scored in all of their rounds. Similarly, participants E1, E2, F1, C1, D1, D2, having records of 3-3, will be allocated ranks 6, 7, 8, 9, 10, and 11 in accordance with their box differentials (or if necessary, total points). At the end of this process each participant will have a rank from one through 16.

A team's score is the sum of the two participants' individual rankings. That is, if one team participant is first and the other is ninth, the team score is ten. The best possible team score is three, and the worst is 31. Teams are then ranked by numbers and the team with the lowest ranking is first, etc. The result will be a ranking of the teams from one to eight for the rummy segment. If more than one team shares the number one ranking, all such number one ranked teams may share equally in the winnings for the rummy segment.

Bridge Segment

In one embodiment of the present invention, the bridge segment is played in groups of four, wherein each group-of-four includes two teams of two participants. In a preferred embodiment of the present invention, IMP scoring is used to score the bridge segment. It should be appreciated, however, that the present invention is not limited to a tournament that includes a bridge segment, or a bridge segment that is played according to the rules of any particular bridge game. Thus, for example, a tournament that includes a bridge segment played according to the rules of Contract Bridge, Auction Bridge, Whist, or any other bridge game generally known to those skilled in the art is considered to be within the spirit and scope of the present invention. It should further be appreciated that the present invention is not limited to a bridge segment that is scored in IMPs, and includes bridge segments that are scored by match points, duplicate bridge scoring, and all other scoring techniques generally known to those skilled in the art.

If the tournament includes 16 participants and eight teams, the eight teams could be randomly labeled A through H and arranged to play seven rounds of bridge. For example, the rounds could be arranged as follows:

| | | |
|---|---|---|
| Round 1 | AB vs. CD | EF vs. GH |
| Round 2 | AC vs. EG | BD vs. FH |
| Round 3 | AD vs. EH | BC vs. FG |
| Round 4 | AE vs. BF | CG vs. DH |
| Round 5 | AF vs. BE | CH vs. DG |
| Round 6 | AG vs. BH | CE vs. DF |
| Round 7 | AH vs. BG | CF vs. DE |

In one embodiment of the present invention, each round consists of eight hands, each group-of-four playing the hand North/South and East/West, wherein partnerships within a group-of-four play the same direction for an entire round. If possible, a partnership should not play the same partnership again.

An example of IMP scoring is as follows:

| Point Difference | I.M.P. |
|---|---|
| 20-40 | 1 |
| 50-80 | 2 |
| 90-120 | 3 |
| 130-160 | 4 |
| 170-210 | 5 |
| 220-260 | 6 |
| 270-310 | 7 |
| 320-360 | 8 |
| 370-420 | 9 |

-continued

| Point Difference | I.M.P. |
|---|---|
| 430-490 | 10 |
| 500-590 | 11 |
| 600-740 | 12 |
| 750-890 | 13 |
| 900-1090 | 14 |
| 1100-1290 | 15 |
| 1300-1490 | 16 |
| 1500-1740 | 17 |
| 1750-1990 | 18 |
| 2000-2240 | 19 |
| 2250-2490 | 20 |
| 2500-2990 | 21 |
| 3000-3490 | 22 |
| 3500-3990 | 23 |
| 4000 and up | 24 |

In one embodiment of the present invention, if the North/South pair one table scores points for the board and the East/West pair on the other table also scores points for the board, then the point difference is obtained by adding the two scores. Upon completion of the rounds, teams are ranked first through eighth, based on win-loss records. In case of ties, the team with the highest IMP score wins.

By way of example, a first round of bridge between group-of-four AB and group-of-four CD will now be described. First, group-of-four AB would separate for play against group-of-four CD. In one area, team A would play eight hands of round one (sitting in North/South position) against team C (sitting in East/West position). In a different area, team D would play those same hands of round one (sitting in North/South position) against team B (sitting in East/West position). Group-of-four AB's result against group-of-four CD is derived from a netting of the results of team A against team C and the results of team D against team B.

For example, if in hand one, team A made a contract of four hearts (non-vulnerable) with an overtrick for a total of 450 points against team C, and team D made a four heart contract with no overtricks for 420 points against team B, then IMP scoring would place group-of-four AB one IMP point ahead of group-of-four CD. This is because a point differential of 30 points is worth one IMP point (according to the chart above). If in hand two, team A bids three no trump (vulnerable) and goes down one trick, losing 100 points, and team D makes the three no trump contract for 600 points, then group-of-four CD would score 12 IMPs (i.e., 700 point differential equals 12 IMPs). If in hand three, team B bids and makes one no trump for a score of 90 points, and team C bids and makes two diamonds, for 90 points; then neither team scores any IMPs (i.e., zero point differential equals zero IMPs).

If round one were to end after three hands, group-of-four CD would win the round with 12 IMPs, as contrasted with group-of-four AB's one IMP. In this example team C would have a win/loss record of 1-0 after round one, team D would have a win/loss record of 1-0, team A would have a win/loss record of 0-1, and team B would have a win/loss record of 0-1. In actuality, however, there would be five more hands of play (eight hands total), and each team's IMPs for the entire eight hands would be totaled and compared to determine the winners of round one. Teams will be ranked by their win/loss records. Ties will be decided in favor of the team with the highest IMP score, then the next highest IMP score, etc. The team with the best record will be the winner of the bridge segment.

Results

Each team's scores in the poker, gin rummy and bridge segments will be added up. Total scores could range from three to twenty-four. The team with the lowest total score will be the first place overall winner, the team with the next lowest score will be second, etc. The prizes will then be divided accordingly.

It should be appreciated that the present invention is not limited to any particular method of determining the overall winner. Thus, for example, assigning more weight to a particular game (e.g., an individual-player game, a team-player game, etc.) or using an algorithm that takes into account individual player performance, is considered within the spirit and scope of the present invention.

Having thus described embodiments of a system and method of participating in a multi-game card tournament to determine who is "the best card player," it should be apparent to those skilled in the art that certain advantages of the system have been achieved. It should also be appreciated that various modifications, adaptations, and alternative embodiments thereof may be made within the scope and spirit of the present invention.

What is claimed is:

1. A method of operating a card-playing tournament, comprising:

providing at least one physical deck of cards;

identifying a plurality of participants to compete in the tournament, wherein the participants are divided into a plurality of two-person teams;

performing a first tournament segment in which the plurality of participants compete playing a first type of card game and forming a first ranking of the plurality of two-person teams based on individual results of the first type of card game, wherein the first type of card game is selected from poker and rummy;

performing a second tournament segment in which the plurality of participants compete playing a second type of card game and forming a second ranking of the plurality of two-person teams based on team results of the second type of card game, wherein the second type of card game is bridge and the participants are divided into four person groups, wherein members of each two person team are grouped together to play at least one round of bridge; and deriving a final ranking of the plurality of two-person teams based on at least a combination of the first and second rankings.

2. The method of claim 1, wherein the first type of card game is poker.

3. The method of claim 1, wherein the first type of card game is rummy.

4. The method of claim 1, further comprising:

performing a third tournament segment in which the plurality of participants compete playing a third type of card game and a third ranking is formed of the plurality of teams based on results of the third type of card game; and deriving a final ranking of the plurality of teams based on at least a combination of the first, second and third rankings.

5. The method of claim 1, wherein the first type of card game is poker and the performing of the first tournament segment further comprises:

forming two-person teams among the plurality of participants;

dividing the participants into smaller groups with team members separated into different groups to play rounds of poker;

deriving a ranking of participants within each of the groups; and combining rankings of the two-person teams to provide the ranking for the first tournament segment.

6. The method of claim 1, wherein the first type of card game is rummy and the performing of the first tournament segment further comprises:

forming two-person teams among the plurality of participants;

dividing the participants into two person groups with team members separated into different groups to play rounds of rummy;

deriving a ranking of participants within each of the groups; and combining rankings of the two-person teams to provide the ranking for the first tournament segment.

7. The method of claim 1, wherein the second type of card game is bridge and the performing of the second tournament segment further comprises: forming two-person teams among the plurality of participants;

dividing the participants into four person groups with team members kept together in each groups to play rounds of bridge; and deriving a ranking of the two-person teams to provide the ranking for the second tournament segment.

8. The method of claim 1, further comprising issuing prizes to the participants in accordance with the final ranking.

9. The method of claim 1, wherein the first type of card game is selected from poker and rummy and the performing of the first tournament segment further comprises:

forming two-person teams among the plurality of participants;

dividing the participants into smaller groups with team members separated into different groups to play rounds of the first type of card game;

deriving a ranking of participants within each of the groups; and combining rankings of the two-person teams to provide the ranking for the first tournament segment.

10. The method of claim 9, wherein the second type of card game is bridge and the performing of the second tournament segment further comprises:

dividing the participants into four person groups with team members kept together in each groups to play rounds of the second type of card game; and deriving a ranking of the two-person teams to provide the ranking for the second tournament segment.

11. The method of claim 10, further comprising issuing prizes to the participants in accordance with the final ranking.

12. The method of claim 1, further comprising: performing a third tournament segment in which the plurality of participants compete playing a third type of card game and a third ranking is formed of the plurality of teams based on results of the third type of card game, wherein the third type of card game is rummy; and deriving a final ranking of the plurality of teams based on at least a combination of the first, second and third rankings.

* * * * *